United States Patent [19]

Seragnoli et al.

[11] Patent Number: 4,528,801

[45] Date of Patent: Jul. 16, 1985

[54] DEVICE FOR FORMING GROUPS OF CIGARETTES IN A CIGARETTE PACKAGING MACHINE

[75] Inventors: Enzo Seragnoli; Gastone Dall'Osso, both of Bologna, Italy

[73] Assignee: G.D. Societa per Azioni, Bologna, Italy

[21] Appl. No.: 492,149

[22] Filed: May 6, 1983

[30] Foreign Application Priority Data

May 28, 1982 [IT] Italy ..... 3443 A/82

[51] Int. Cl.[3] ..... B65G 57/09

[52] U.S. Cl. ..... 53/494; 53/150; 53/151

[58] Field of Search ..... 53/494, 151, 150, 149, 53/148

[56] References Cited

U.S. PATENT DOCUMENTS

| | | | |
|---|---|---|---|
| 3,520,394 | 7/1970 | Seragnoli | 53/151 UX |
| 3,771,279 | 11/1973 | Seragnoli | 53/494 X |
| 3,917,049 | 11/1975 | Shirai et al. | 53/151 X |
| 4,209,955 | 7/1980 | Seragnoli | 53/150 X |
| 4,362,235 | 12/1982 | Erdmann | 53/151 X |

*Primary Examiner*—James F. Coan

[57] ABSTRACT

A device for forming groups of cigarettes in a cigarette packaging machine, in which an outlet hopper of a cigarette feed apparatus comprises a plurality of adjacent outlet mouths each arranged to deliver successive layers of cigarettes. Pusher means disposed below each outlet mouth insert said layers in superposed relationship into containers uniformly distributed along a conveyor which is mobile stepwise in proximity to the base of the hopper. Each pusher means is operable independently of the others, and can be deactivated on sensing determined irregular situations in the containers or during the starting or stopping stages of the packaging machine.

3 Claims, 2 Drawing Figures

DEVICE FOR FORMING GROUPS OF CIGARETTES IN A CIGARETTE PACKAGING MACHINE

BACKGROUND OF THE INVENTION

The present invention relates to a device for forming groups of cigarettes in a cigarette packaging machine.

More particularly, the present invention relates to a device for forming groups of cigarettes each arranged to constitute the contents of one packet.

In cigarette packaging machines, for feeding the cigarettes to the wrapping line it is known to use a hopper which delivers cigarettes, by way of its bottom end, to an intermittently driven conveyor on which the formation of said groups takes place. This conveyor, which can extend either linearly or along a curved path, is provided with a plurality of seats or containers which, as the conveyor advances, pass through a loading station situated at the bottom end of said hopper, and receive therefrom several layers of cigarettes in succession.

Specifically, in the most common case, said hopper comprises three separate outlet mouths, each of which is divided into a plurality of channels of number equal to the number of constituent cigarettes of the individual layers. Three pusher elements disposed below the outlet mouths are simultaneously operated during each dwell stage of said conveyor in order to extract three respective layers of cigarettes from the opper and insert them into the facing containers. These pusher elements are situated at increasing levels, with reference to the direction of advancement of said conveyor, and provide respectively for inserting into three corresponding containers at each dwell stage of said conveyor, a first lower layer, an intermediate layer and an upper layer of cigarettes, of which the supersuposed arrangement gives rise, downstream of the loading station at each conveyor advancement step, to one complete group comprising three layers of superposed cigarettes.

The described method for forming groups of cigarettes for packaging, for a more detailed description of which reference should be made to British Pat. No. 1,137,826 of same applicant G.D. S.p.A., gives excellent performance when the packaging machine has reached its normal working speed, but has some drawbacks during the starting of the machine.

In this respect, on starting the machine, said container are completely empty, and whereas the lower pusher can regularly insert a relative first layer into the container which faces it, the other two pushers introduce the relative layers into containers from which the first layer and, respectively, the first and second layer are missing.

The result of this is that besides forming some incomplete groups which must of necessity be discarded before they reach the actual wrapping line, there is the not infrequent need to stop the packaging machine in order to extract those cigarettes which, because of the incompleteness of the groups of which they form part, have assumed incorrect positions such as to cause build-up along the conveying line.

A further drawback relating to the use of the described forming device derives from the fact that in this device there is no possibility of preventing the completion of those groups in which cigarettes are absent or which comprise defective cigarettes in the first or second layer. In other words, even those groups of which the first or second layer are defective to the extent of requiring their subsequent expulsion, are completed by superposing the missing layers. This results in considerable economic damage, in that the number of discarded cigarettes is thus considerably larger than is strictly necessary.

A further limitation relating to the use of the described forming device derives from the fact that it is not possible, for example in order to carry out maintenance work, to completely free the packaging machine of the cigarettes in transit, and then stop it, without having to discard a certain number of cigarettes. In this respect it is inevitable that at any moment at which it is decided to stop the machine, groups of cigarettes which have not yet received all their layers are present on said conveyor. Even if said pushers are halted before the machine is stopped in order to allow all the complete groups present on the conveyor to be wrapped, said groups which lack one or more layers must be expelled.

SUMMARY OF THE INVENTION

The object of the present invention is to provide a device for forming groups of cigarettes in a cigarette packaging machine which during the starting and stopping of the machine do not lead to the production of incomplete groups of cigarettes which have to be discarded.

A further object of the present invention is to provide a device for forming groups of cigarettes which is able to reduce the total number of cigarettes to be discarded downstream of the forming device, even when the packaging machine is operating at its normal working speed.

These and further object are all attained according to the present invention by a device for forming groups of cigarettes in a cigarette packaging machine, comprising a cigarette feed apparatus outlet hopper with a plurality of outlet mouths; a conveyor along the periphery of which there are uniformly distributed containers for said groups, which are arranged to receive in succession several superposed layers of cigarettes, each layer fed from a respective said outlet mouth by pusher means; and control means for said layers, disposed along the path of said conveyor; characterised in that said pusher means are operable independently of each other in determined phase relationship with said conveyor, and means are provided for selectively inhibiting them.

DESCRIPTION OF THE PREFERRED EMBODIMENT

Figures 1, 2:
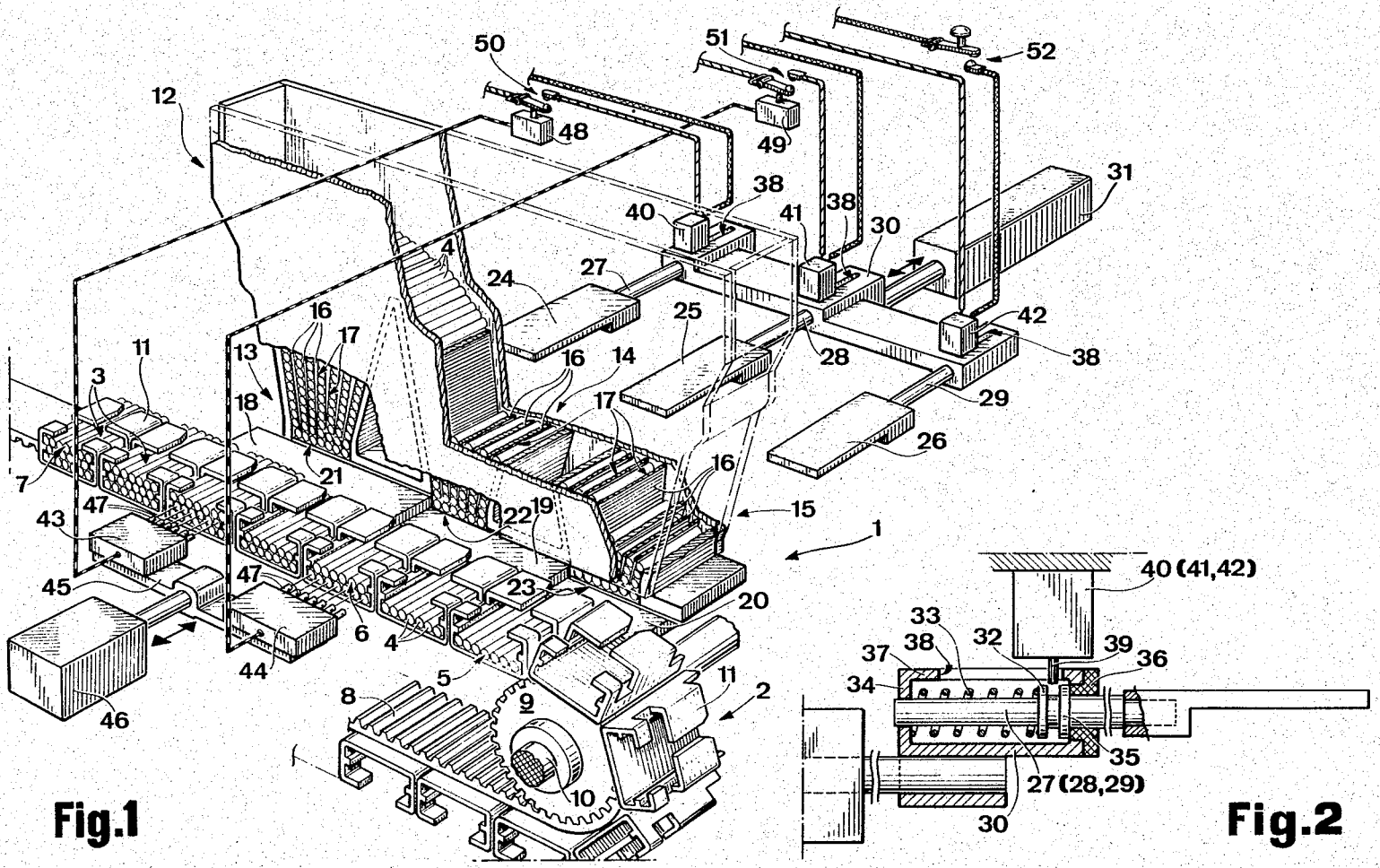
FIG. 1 is a diagrammatic perspective view of a forming device constructed according to the present invention.
FIG. 2 is a diagrammatic side sectional view of a detail of FIG. 1.

FIG. 1 shows a device for forming groups of cigarettes, which is indicated overall by 1 and comprises a conveyor 2 arranged to transfer to a packaging line (not shown) groups 3 of cigarettes 4, each group constituting the contents of one packet (not shown). Each group 3 is formed from several superposed layers of cigarettes 4, three in the example illustrated, which are indicated from the bottom upwards by 5, 6 and 7.

The conveyor 2 comprises a conveyor belt 8 passing endlessly about two end rollers 9 which are supported and driven with intermittent rotary motion about their axis by respective horizontal shafts 10 parallel to each other. On the surface of said belt 8 there is fixed a succession of equidistant containers 11 of substantially hollow parallelepiped form and open at two opposing axial ends which flank the lateral edges of said belt 8. During each dwell stage of the conveyor 2, three said containers 11 face three separate outlet mouths of a hopper 12 constitutint the end portion of a cigarette feed apparatus, not shown. Said outlet mouths, indicated respectively by 13, 14 and 15 from left to right, are divided by substantially vertical baffles 16 into a plurality of channels 17 of number equal to the number of cigarettes 4 constituting the layers 5, 6 and 7 respectively. As shown in FIG. 1, the channels 17 are bounded lowerly, below the outlet mouths 13, 14 and 15, by three respective fixed horizontal plates 18, 19 and 20. Said plates 18, 19 and 20 have their upper surfaces disposed at decreasing levels, from left to right with reference to FIG. 1, the level differences between one and the other being substantially equal to the diameter of a cigarette 4, and in combination with the mouths 13, 14 and 15 they define three horizontal slots indicated respectively by 21, 22 and 23. The upper surface of the plate 20 is disposed coplanar with the horizontal base plane of the containers 11.

At the slots 21, 22 and 23 there operate three thrust means or pusher elements 24, 25 and 26, constituted by substantially rectangular plates disposed aligned with said slots 21, 22 and 23 respectively. Those ends of the pusher elements 24, 25 and 26 which are distant from the hopper 12 are rigid with respective shafts 27, 28 and 29, which are parallel to the shafts 10 and are supported slidable along their axes by a substantially parallelepiped box element 30 (see FIG. 2). The box element 30 is driven with reciprocating motion in a direction parallel to the shafts 10 by an actuator element 31 of known type operating in determined phase relationship with the conveyor 2.

As can be seen in FIG. 2, each of the shafts 27, 28 and 29 rigidly carries, on an intermediate portion thereof within the box element 30, an annular member 32 constituting a stop element for one end of a spiral spring 33, which winds coaxially about each of the shafts 27, 28 and 29 and rests by way of its other end against an end wall 34 of the box element 30. A second annular member 35 is rigid with each of the shafts 27, 28 and 29 in a zone lying between the annular member 32 and a wall 36 of the box element 30 opposite the wall 34, and is kept in contact with said wall 36 by the pressure exerted by the relative spring 33.

An upper wall 37 of the box element 30 is provided with three slots 38 parallel to the shafts 27, 28 and 29 and disposed above them, only one of the slots being shown in FIG. 2. Three vertical pins 39 supported by the armatures of respective expulsion electromagnets or inhibition means 40, 41 and 42 supported above the box element 30 in a manner not shown, extend through said slots 38 and between the annular members 32 and 35 of each shaft 27, 28 and 29.

During each dwell stage of the conveyor 2, the pushers 24, 25 and 26, by passing through the slots 21, 22 and 23, are able to extract respective layers 7, 6 and 5 cigarettes 4 from the opper 12 and to insert them at three different levels into the containers 11 facing them. More specifically, the pusher 26 is designed to insert the lower layer 5 into the containers 11, the pusher 25 superposes the intermediate layer 6 onto the layer 5, and the pusher 24 completes each group 3 by disposing a layer 7 on the layer 5 and 6.

Two devices or means for controlling the presence of the layers 6 and 5 of cigarettes 4 in the containers 11, indicated by 43 and 44 respectively, are supported adjacent to that side of the conveyor 2 distant from the hopper 12, by a horizontal bar 45 normal to the shafts 10. This bar is driven with reciprocating motion in a direction parallel to the shafts 10 and in determined phase relationship with the conveyor 2, by an actuator element 46 of known type. The control means 43 and 44, which can be of any type and which hereinafter will by way of example be considered to be of electromechanical type, are each provided with a number of horizontally adjacent feeler pins 47 equal to the number of cigarettes 4 contained in the layers 6 and 5 respectively. The feeler pins 47 of each control means 43 and 44 are disposed in such a manner that during each dwell stage of the conveyor 2, they respectively face the ends of the cigarettes 4 constituting a layer 6 or 5.

Said control devices 43 and 44, of known type and described in detail in British Pat. No. 1,298,785 of the same applicant G.D. S.p.A., are connected respectively to inhibitor means or remote control switches 48 and 49 able, when energized, to close respective normally open contacts 50 and 51 which are present in respective electrical supply lines of the electromagnets 40 and 41. The remote control switches 50 and 51 are energized by way of the devices 43 and 44 each time these detect the absence or incompleteness of a layer 6 or 5, or an end defect in one or more cigarettes 4 thereof.

The reference numeral 52 indicated a normally open switch means or contact which can be operated manually or automatically and is connected into the electrical supply line of the electromagnet 42.

When in operation, on termination of each advancement step of the conveyor 2, three containers 11 become disposed in positions corresponding with the outlet mouths 13, 14 and 15 of the hopper 12.

At the commencement of each dwell stage of the conveyor 2, the control devices 43 and 44 are urged by the actuator element 46 towards the containers 11 which face them, and by means of the feeler pins 47 they test the presence and regularity of the layers 6 and 5 of cigarettes 4 respectively.

If no irregularity is detected by the control devices 43 and 44, the pushers 24, 25 and 26, operated by the actuator element 31, insert respective layers 7, 6 and 5 into the containers 11 which are at rest in front of the outlet mouths 13, 14 and 15.

During the course of this insertion, the pushers 24, 25 and 26 practically form a single body with the box element 30, in that the springs 33 keep the annular members 35 of the shafts 27, 28 and 29 in contact with the wall 36.

In contrast, if the pins 47 of one or both of the devices 43, 44 detect the absence of the respective layer 6, 5 (usually during the starting of the packaging machine), or detect the absence of one or more cigarettes 4 or an end defect thereof, the device 43, 44 which has detected the irregularity determines the energization of the remote control switch 48, 49 associated with it, and the consequent closure of the relative contact 50, 51. This is immediately followed by the energization of one or both of the electromagnets 40 and 41, with the consequent insertion of the free end of each relative pin 39 into the groove defined in the corresponding shaft 27, 28 by the annular members 32 and 35.

During the course of the next movement towards the hopper 12 by the box element 30, access to the slot 21, 22 by the pusher 24, 25 rigid respectively with said shaft 27, 28 is therefore prevented by the contact between the pin 39 and annular member 32.

If for the purpose heretofore described it is required to halt the packaging machine and free it completely of the cigarettes 4 in transit before stoppage, it is necessary only to close the contact 52 in order to suspend the feed to the containers 11. In this respect, this action causes energization of the electromagnet 42 and the consequent inhibition of the pusher 26 by the relative pin 39 in the manner heretofore described. Following this, the control device 44 begins to detect the absence of the layer 5 of cigarettes 4 in the containers 11, and deactivates the pusher 25 associated with this layer.

By a similar mechanism, the control device 23 deactivates the pusher 24, and the packaging machine can complete the wrapping of the groups 3 which are present, without it being necessary to expel those which are incomplete.

It is apparent that under any operating condition of a cigarette packaging machine, the described device enables the total quantity of discarded cigarettes to be substantially reduced. In this respect, both during the starting and stopping stages of the machine, the device according to the present invention prevents the formation of incomplete groups of cigarettes which would inevitably be expelled, and also prevents the completion of those groups in which an irregularity has been detected, thus further reducing the necessarily discarded quantity.

Within the principle of the invention, numerous modifications can be made to the device which has been described by way of nonlimiting example, without leaving the scope of the present invention.

What I claim is:

1. A device for forming groups of cigarettes in a cigarette packing machine, the device comprising:

an outlet hopper of a cigarette feed apparatus having a plurality of outlet mouths;

a conveyor running along a path and having uniformly distributed on its periphery equispaced containers for said cigarette groups, each container being arranged to receive in succession several superposed layers of cigarettes fed from a respective outlet mouth;

control means for sensing the condition of said layers, the control means being disposed along said path of the conveyor;

a plurality of pusher means each for feeding a cigarette layer into said containers;

operating means associated with the pusher means and adapted to normally operate all the pusher means in unison in determined phase relationship with the conveyor, the pusher means additionally being capable of independent operation relative to each other; and inhibiting means connected to the control means for selectively inhibiting the operation of any one or more pusher means when the condition of a layer is defective.

2. A device for forming groups of cigarettes as claimed in claim 1, wherein each inhibiting means for a pusher means relative to a determined layer is governed by control means relative to the layer which lies immediately below said determined layer.

3. A device for forming groups of cigarettes as claimed in claim 1, wherein the inhibiting means relative to the pusher means operating on the first layer of each said container are controlled by switch means independent of said control means.

* * * * *